US009675178B2

(12) United States Patent
Lu

(10) Patent No.: US 9,675,178 B2
(45) Date of Patent: Jun. 13, 2017

(54) ELECTRIC SUPPORT SYSTEM FOR SOFA

(71) Applicant: Dongguan Weihong Hardware and Plastic Products Co., Ltd., Dongguan (CN)

(72) Inventor: Wei Lu, Dongguan (CN)

(73) Assignee: DONGGUAN WEIHONG HARDWARE AND PLASTIC PRODUCTS CO., LTD., Dongguan (CN)

( * ) Notice: Subject to any disclaimer, the term of this patent is extended or adjusted under 35 U.S.C. 154(b) by 125 days.

(21) Appl. No.: 14/808,258

(22) Filed: Jul. 24, 2015

(65) Prior Publication Data

US 2016/0345740 A1 Dec. 1, 2016

(30) Foreign Application Priority Data

Jun. 1, 2015 (CN) ..... 2015 1 0292744

(51) Int. Cl.
*A47C 7/36* (2006.01)
*A47C 7/38* (2006.01)
*A47C 17/04* (2006.01)

(52) U.S. Cl.
CPC ..... *A47C 7/38* (2013.01); *A47C 17/04* (2013.01)

(58) Field of Classification Search
CPC ..... A47C 7/38; A47C 17/04
USPC ..... 297/408, 409, 410, 354.11
See application file for complete search history.

(56) References Cited

U.S. PATENT DOCUMENTS 1,756,825 A * 4/1930 Hess ..... B60N 2/20 297/309
1,762,623 A * 6/1930 Hess ..... B60N 2/7088 297/309
2,660,734 A * 12/1953 Dumble ..... A47C 17/16 297/354.11
3,215,468 A * 11/1965 Swenson ..... A47C 7/445 297/284.1
4,626,028 A * 12/1986 Hatsutta ..... B60N 2/2222 297/284.1
4,765,683 A * 8/1988 Hattori ..... B60N 2/4855 297/408
5,011,225 A * 4/1991 Nemoto ..... B60N 2/4852 297/408
5,052,754 A * 10/1991 Chinomi ..... B60N 2/4838 297/408
5,145,233 A * 9/1992 Nagashima ..... B60N 2/487 297/403
5,288,129 A * 2/1994 Nemoto ..... B60N 2/4838 297/408

(Continued)

*Primary Examiner* — David R Dunn
*Assistant Examiner* — Alexander Harrison
(74) *Attorney, Agent, or Firm* — Shimokaji IP

(57) ABSTRACT

An electric support system for sofa includes a linear drive device and at least one adjusting assembly, the adjusting assembly includes a side plate, a slider, a first connecting link, and a second connecting link, the slider is slidably configured on the side plate and driven by the linear drive device to slide on the side plate, one end of the first connecting link is pivotally connected to the slider, the other end of the first connecting link is pivotally connected to one end of the second connecting link, the other end of the second connecting link is an end adapted for fixing headrest, and the second connecting link is also pivotally connected to the side plate with a pivot configured between the two ends of the second connecting link. The headrest can be adjusted to any angle or any position without limitations.

6 Claims, 8 Drawing Sheets

(56) References Cited

U.S. PATENT DOCUMENTS 5,370,443 A * 12/1994 Maruyama ..... B60N 2/2222 297/284.1
8,042,415 B2 * 10/2011 Ito ..... B60N 2/0232 297/408
8,262,164 B2 * 9/2012 Ito ..... B60N 2/0232 297/354.1
8,702,173 B2 * 4/2014 Adams ..... A47C 7/38 297/403
8,899,683 B2 * 12/2014 Ito ..... B60N 2/1615 297/354.11
2002/0084686 A1 * 7/2002 Takata ..... B60N 2/4855 297/408
2004/0012234 A1 * 1/2004 Yamaguchi ..... B60N 2/0276 297/216.12
2004/0195895 A1 * 10/2004 Sedlatschek ..... A47C 7/38 297/408
2005/0067874 A1 * 3/2005 Kamrath ..... B60N 2/4858 297/408
2005/0168020 A1 * 8/2005 Yetukuri ..... B60N 2/4885 297/216.12
2006/0226690 A1 * 10/2006 Neale ..... A47C 7/38 297/408
2008/0007105 A1 * 1/2008 Viger ..... A47C 7/38 297/408
2008/0252128 A1 * 10/2008 Nishikawa ..... B60N 2/2222 297/354.11
2008/0290713 A1 * 11/2008 Oda ..... B60N 2/0232 297/408
2009/0152924 A1 * 6/2009 Kim ..... B60N 2/4855 297/408
2010/0102605 A1 * 4/2010 Yamada ..... A47C 7/38 297/284.3
2010/0270840 A1 * 10/2010 Tanaka ..... B60N 2/2222 297/354.11

* cited by examiner

ELECTRIC SUPPORT SYSTEM FOR SOFA

RELATED APPLICATIONS

This application claims the benefit of priority to Chinese Patent Application No. 201510292744.X filed in Jun. 1, 2015, which is hereby incorporated by reference in its entirety.

FIELD OF THE INVENTION

The present invention relates to a field of furniture parts, more particularly to an electric support system for automatically adjusting a tilting angle of a sofa headrest.

BACKGROUND OF THE INVENTION

Commonly, angles of a headrest of a seat, a sofa or other furniture can be adjusted to meet the requirement of the customers. One of the achievement manners is to set a hinge connected with the headrest in the seat or sofa, and the headrest rotates with the hinge so as to change the angle between the headrest and the seat or sofa. As such, the customer can adjust different tilting angles of the headrest according to his actual requirement to obtain a comfortable feeling.

However, this adjusting manner that a hinge is used to adjust the angle of the headrest must require a manual operation to pull the headrest, which brings a time and effort-consuming and inconvenient operation. In addition, due to the limitations of the hinge structure, the headrest just can be located in a limited number of using position but can not be located in any position, thereby limiting the adjusting. Furthermore, when customer needs to adjust the headrest back, the headrest needs to be pulled to a lowest position so as to disengage the hinge, so that the headrest can be rotated back freely, which also brings an inconvenient operation.

Thus it's necessary to provide an electric support system for automatically adjusting and locating the headrest of sofa in any position.

SUMMARY OF THE INVENTION

One objective of the present invention is to provide an electric support system for automatically adjusting and locating the headrest of sofa in any position and freely adjusting the headrest back.

To achieve the above objective, an electric support system for sofa is provided, which includes a linear drive device and at least one adjusting assembly, the adjusting assembly includes a side plate, a slider, a first connecting link, and a second connecting link; wherein the slider is slidably configured on the side plate and driven by the linear drive device to slide on the side plate, one end of the first connecting link is pivotally connected to the slider, the other end of the first connecting link is pivotally connected to one end of the second connecting link, the other end of the second connecting link is an end adapted for fixing headrest, and the second connecting link is also pivotally connected to the side plate with a pivot configured between the two ends of the second connecting link.

In comparison with the prior art, the electric support system for sofa of the present invention is provided with the linear drive device and at least one adjusting assembly. The slider of the adjusting assembly is slidably configured on the side plate, the first connecting link is pivotally connected to the second connecting link, and the first connecting link and the second connecting link are respectively connected to the slider and the side plate. After the side plate is fixed in the sofa, and the end adapted for fixing headrest of the second connecting link is fixed to the headrest, the angle adjustment of the headrest can be implemented by the electric support system for sofa. Concretely, the linear drive device is started to actuate the slider to slide on the side plate, and the sliding slider actuates the second connecting link by the first connecting link to rotate relative to the side plate, and then the angle between the end adapted for fixing headrest of the second connecting link and the side plate can be changed, thereby the headrest can be adjusted to any angle or any position without limitations and can be adjusted back as long as the linear drive device starts in a reverse direction, the operation of which is convenient.

Preferably, the first connecting link is a linear link, the second connecting link includes a first segment and a second segment, one end of the first segment is pivotally connected to the first connecting link, the other end of the first segment is fixed to one end of the second segment and there is an angle between the first segment and the second segment, the other end of the second segment is the end adapted for fixing headrest, and the pivot is located at a position where the first segment is fixed to the second segment.

Concretely, a sliding hole is opened in the side plate, and the slider is slidably configured in the sliding hole.

More concretely, the sliding hole is configured to be oblique to a length direction of the side plate, and the linear drive device is correspondingly configured to be oblique.

Further, the second connecting link is pivotally connected to a front end of the side plate, the first segment is protruded from the pivot to a rear end of the side plate, and the sliding hole extends from the top down and towards the front end of the side plate.

Preferably, the adjusting assembly further includes a fastener, which includes a first fixing portion and a second fixing portion that is fixed and roughly perpendicular to the first fixing portion, and the first fixing portion is fixed to the end adapted for fixing headrest of the second connecting link.

Preferably, pivoting axis of the first connecting link and the slider, pivoting axis of the first connecting link and the second connecting link, and pivoting axis of the second connecting link and the side plate are configured in parallel.

Preferably, the number of the adjusting assembly is two, and the electric support system for sofa further includes a connecting rod, two ends of which are respectively fixed to the sliders of the two adjusting assemblies, and the linear drive device is connected to the connecting rod.

Concretely, the linear drive device has a rectilinearly telescopic output shaft, which is pivotally connected to the connecting rod.

More concretely, the linear drive device includes a linear motor.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
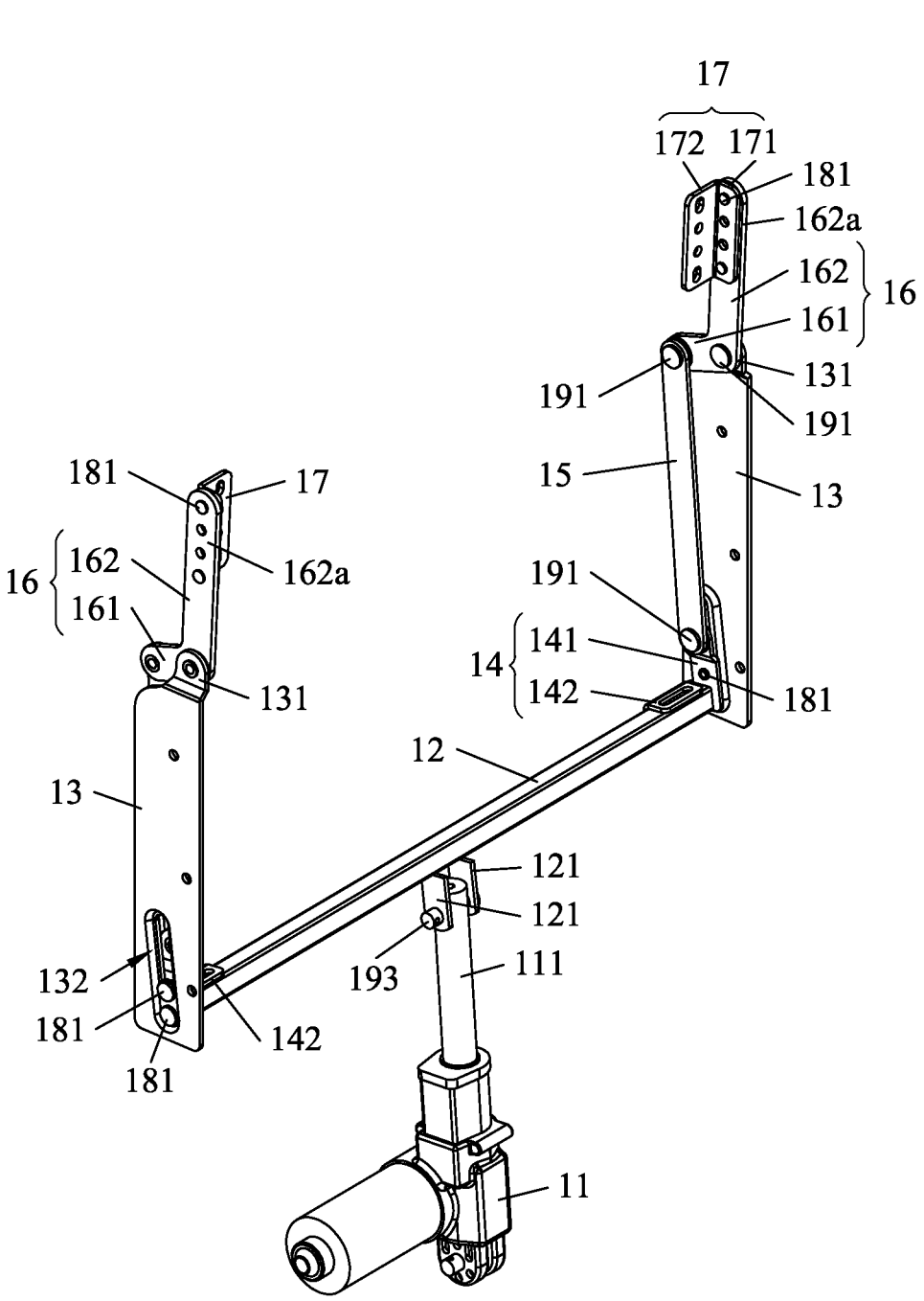
FIG. 1 is a perspective view of an electric support system for sofa according to one embodiment of the present invention.

As illustrated in FIGS. 1-4, an electric support system for sofa 1 is provided, which can be mounted in a sofa and connected with a headrest so as to automatically adjust the headrest to any angle. The electric support system for sofa 1 includes a linear drive device 11, two adjusting assemblies and a connecting rod 12. The two adjusting assemblies are symmetrically arranged on two ends of the connecting rod 12, the specific structure of the adjustment assembly will be firstly detailed as follow, and then detailing the connection way that the adjustment assembly is connected to the linear drive device 11 and the connecting rod 12.

Each adjusting assembly includes a side plate 13, a slider 14, a first connecting link 15, a second connecting link 16, and a fastener 17.

The shape of the side plate 13 is not limited, but is in a shape of a strip in the present embodiment, a pivoted portion 131 is formed at the front end of the top of the side plate 13, a sliding hole 132 is opened at a position near the bottom of the side plate 13, which is configured to be oblique to a length direction of the side plate 13 and penetrates through the side plate 13. Concretely, the sliding hole 132 extends from the top down and towards the front end of the side plate 13. The slider 14 includes a plate-like sliding portion 141 and a connecting portion 142 fixed to the sliding portion 141, the connecting portion 142 has an L-shaped cross-section, wherein the sliding portion 141 is slidably disposed in the sliding hole 132 so as to slide up and down on the side plates 13. The connection way of the slider 14 and the sliding hole 132 is that a plastic member 18 slidably received within the sliding hole 132 is fixed with two rivets 181 that is then fixed to the slider 14, thereby the slider 14 is slidably connected in the sliding hole 132.

Figure 2:
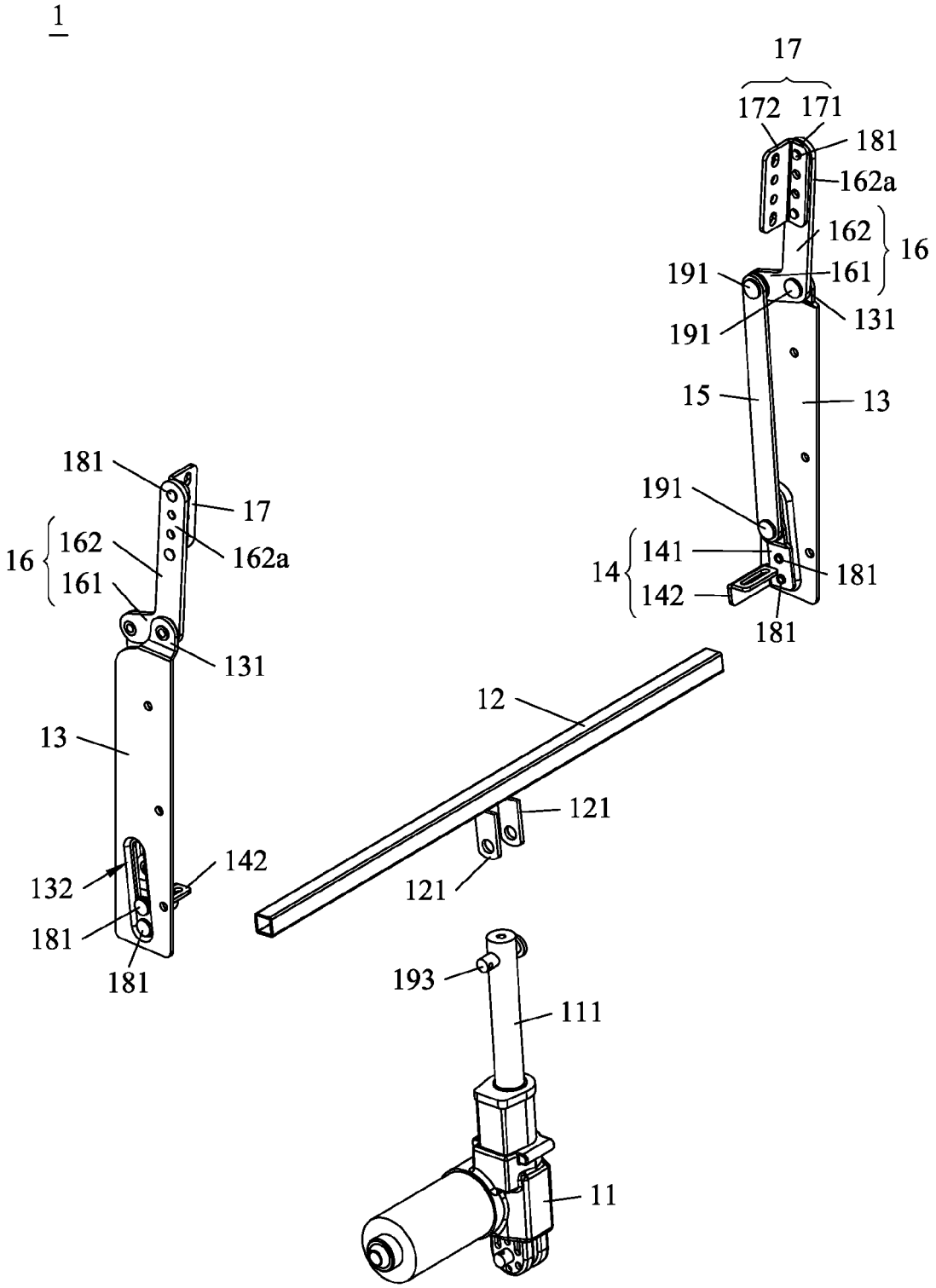
FIG. 2 is an exploded view of the electric support system for sofa according to one embodiment of the present invention.
Figure 3:
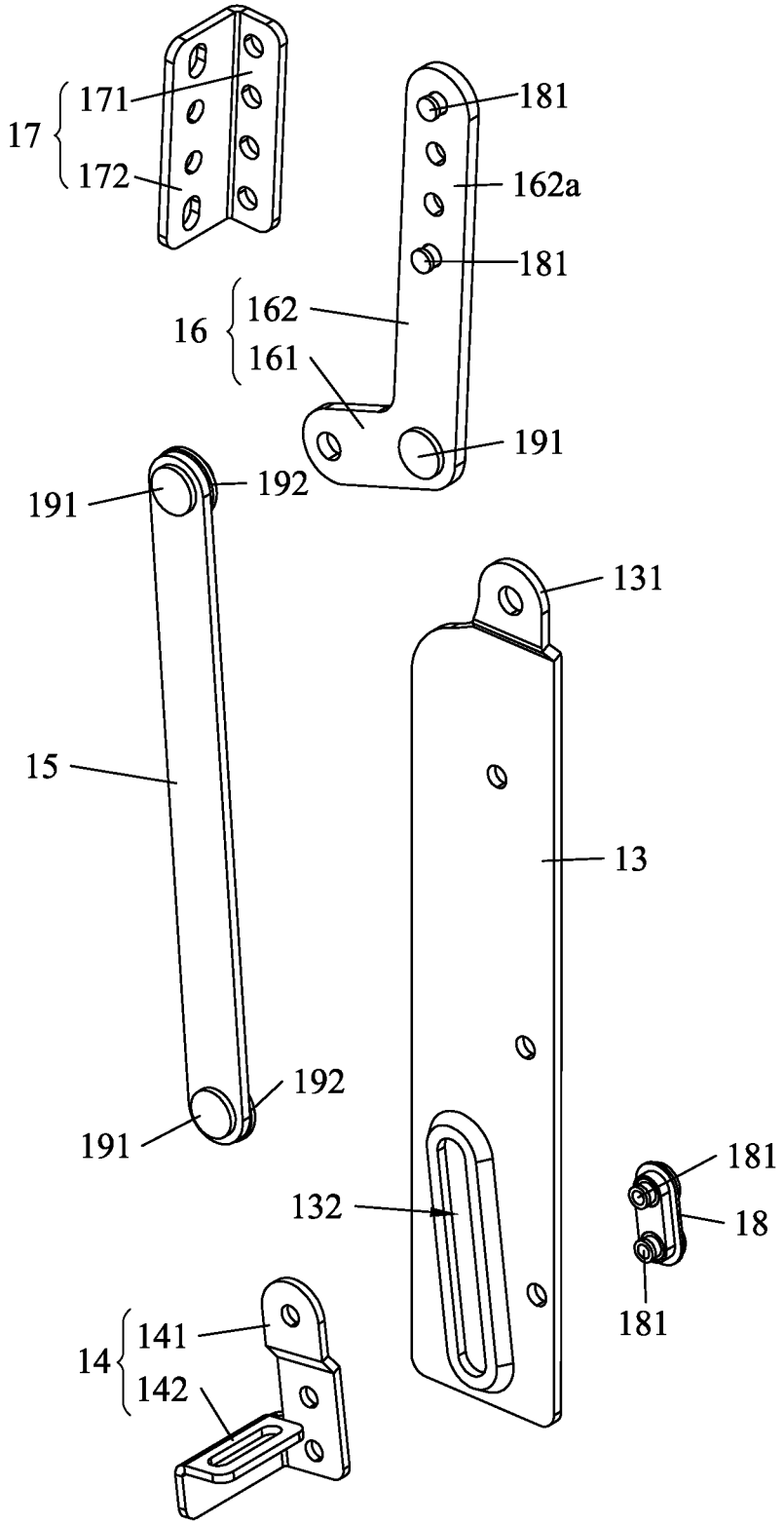
FIG. 3 is an exploded view of an adjusting assembly of the electric support system for sofa according to one embodiment of the present invention.
Figure 4:
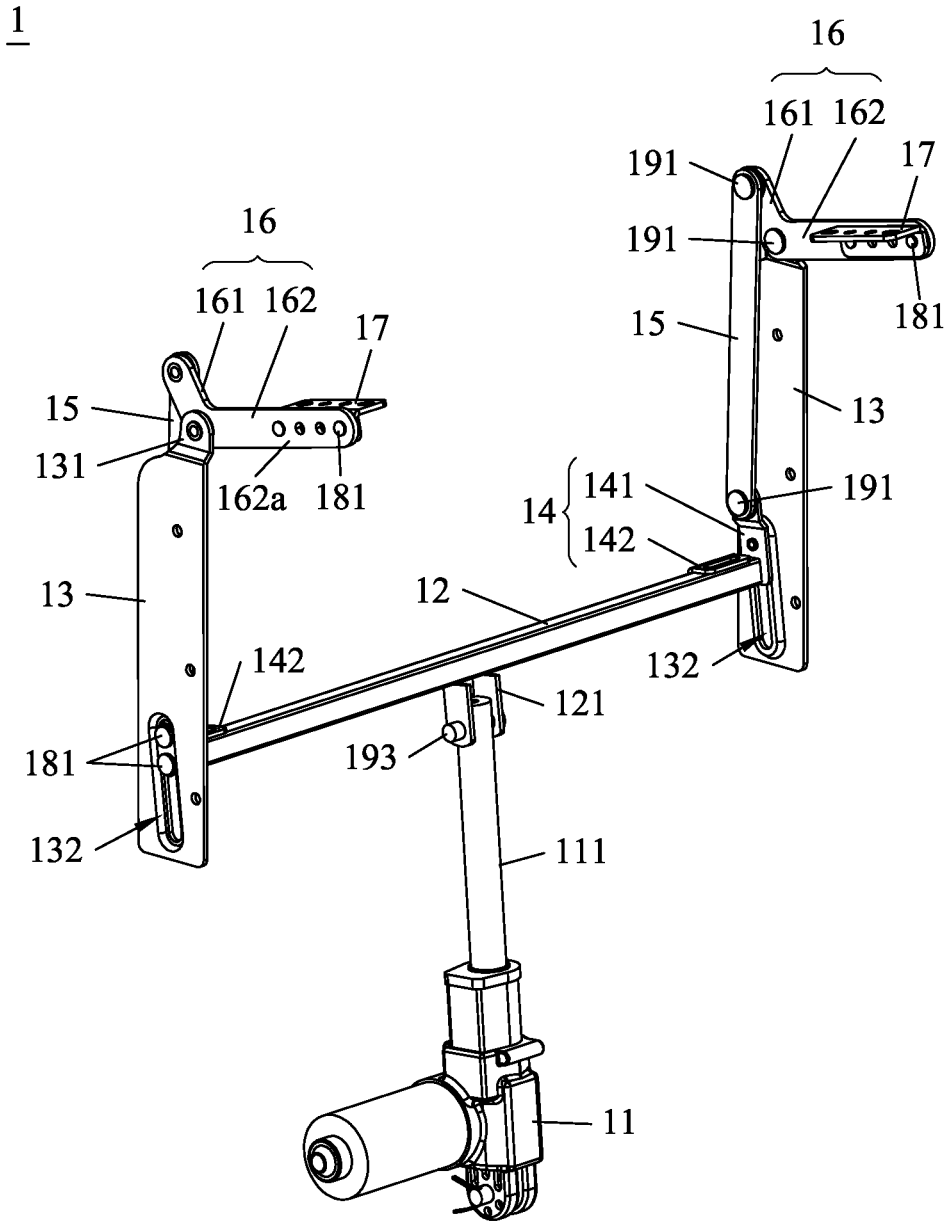
FIG. 4 is a perspective view of an electric support system for sofa according to another embodiment of the present invention.

The first connecting link 15 is a linear link, the lower end of which is pivotally connected to the upper end of the sliding portion 141 of the slider 14 and the upper end of which is pivotally connected to an end of the second connecting link 16. The second connecting link 16 is roughly in a shape of L and includes a first segment 161 and a second segment 162, one end of the first segment 161 is pivotally connected to the first connecting link 15, the other end of the first segment 161 is fixed to one end of the second segment 162 and there is an angle between the first segment 161 and the second segment 162, the other end of the second segment 162 is an end adapted for fixing headrest 162*a*. The position where the first segment 161 is connected with the second segment 162 is pivotally connected to the pivoted portion 131 at the top of the side plate 13, namely the second connecting link 16 is pivotally connected to the side plate 13 with a pivot configured between the two ends of the second connecting link 16. As shown in FIG. 2, relative to the position where the second connecting link 16 is pivotally connected to the side plate 13, the first segment 161 extends towards a rear end of the side plate 13 and the second segment 162 extends upward. The fastener 17 includes a first fixing portion 171 and a second fixing portion 172 that is fixed and roughly perpendicular to the first fixing portion 171, the first fixing portion is fixed to the end adapted for fixing headrest 162*a* of the second connecting link 16 by the rivet 181.

The pivotal connection of the first connecting link 15 with the slider 14 and the second connecting link 16 and the pivotal connection of the second connecting link 16 with the side plate 13 are implemented by pins 191. The pivoting axis of the first connecting link 15 and the slider 14, the pivoting axis of the first connecting link 15 and the second connecting link 16 and the pivoting axis of the second connecting link 16 and the side plate 13 are configured in parallel. Meanwhile, a spacer 192 is configured between each pin 191 and each member so as to minimize the friction occurring between the members pivotally connected when relatively rotated. Further, the slider 14, the second connecting link 16 and the fastener 17 are divided into two parts just for enough clear description, but in the actual production, the slider 14, the second connecting link 16 and the fastener 17 are formed integrally.

Two ends of the connecting rod 12 are respectively fixed to the sliders 14 of the two adjusting assemblies, particularly, the connecting portion 142 of the slider 14 clings to two surfaces of the connecting rod 12, and then fixing them by welding or riveting. The linear drive device 11 has a rectilinearly telescopic output shaft 111, which is pivotally connected to the connecting rod 12, and the linear drive device 11 is a linear motor in this embodiment. Specifically, the connecting rod 12 includes two pivot pieces 121 protruded downward and spaced from each other, output shaft 111 is inserted between the two pivot pieces 121, a pin 193 passes through the two pivot pieces 121 and the output shaft 111 so as to connect the output shaft 111 with the connecting rod 12 and rotate the output shaft 111 relative to the connecting rod 12. As the sliding hole 132 on the side plate 13 is configured to be oblique, and therefore the linear drive device 11 is correspondingly configured to be oblique, thereby the slider 14 can slider in the sliding hole 132 smoothly.

Figure 5:
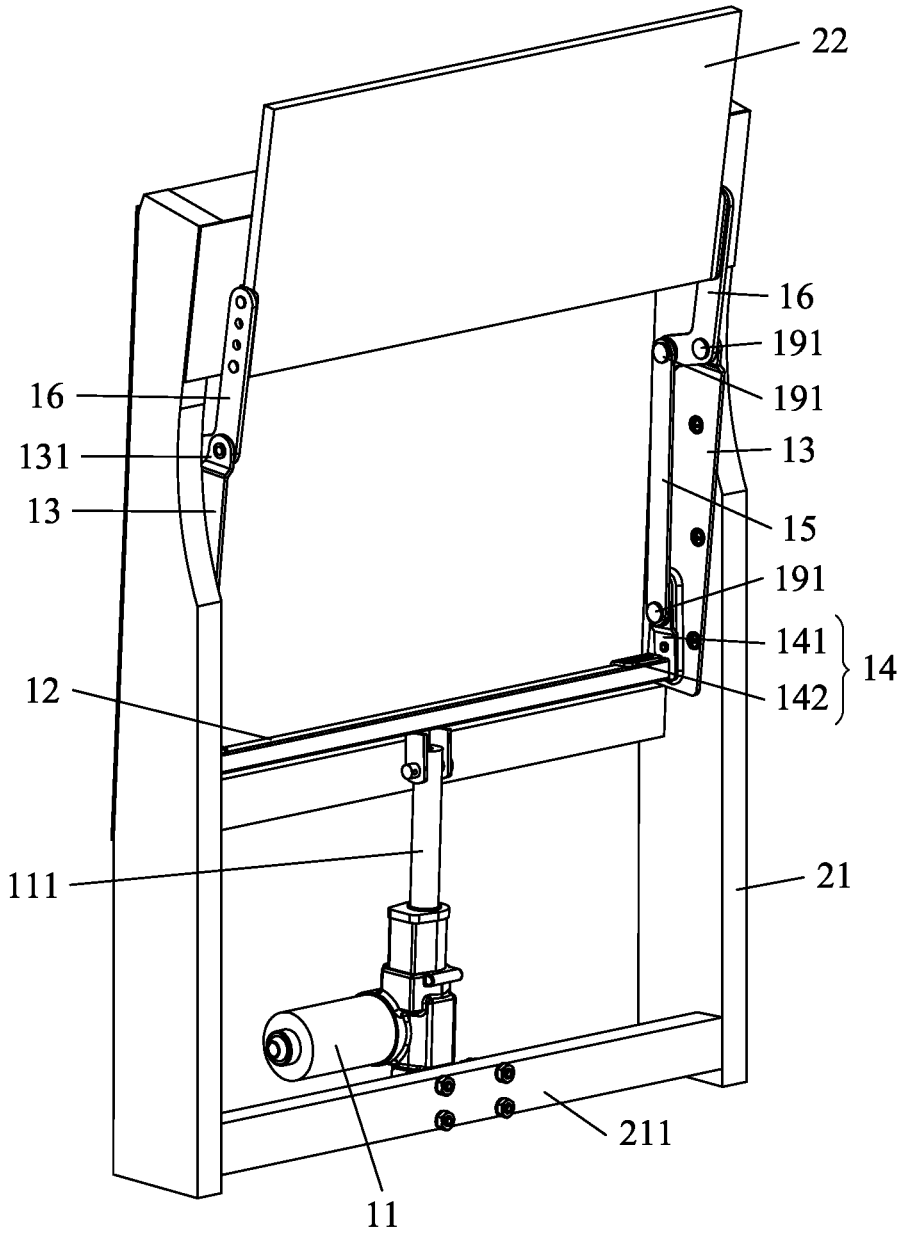
FIG. 5 is a perspective view of the electric support system for sofa fixed to a support pedestal in a sofa of the present invention.

Combining the above Figs with FIG. 5, a support pedestal in the sofa includes a base 21 and a flat plate 22 fixed in the headrest of the sofa. The electric support system for sofa 1 of the present invention is mounted in such a way: the bottom of the linear drive device 11 is fixed to a rail 211 at the bottom of the base 21, and the two adjustment assemblies are mounted on both sides of the base 21, wherein the base plate 13 is fixed to a side portion of the base 21 and configured to be oblique so as to make the sliding hole 132 extend roughly in the vertical direction. The two second fixing portion 172 of the two fasteners 17 are respectively fixed to both ends of the flat plate 22. When the customers need to adjust the position or angle of the flat plate 22, starting the linear drive device 11, so that the output shaft 111 extends out, the output shaft 111 push the connecting rod 12 to move upward so as to drive the slider 14 fixed with the connecting rod 12 to slide upward in the sliding hole 132, the slider 14 push the first segment 161 of the second connecting link 16 upward by the first connecting link 15 during sliding.

Figure 6:
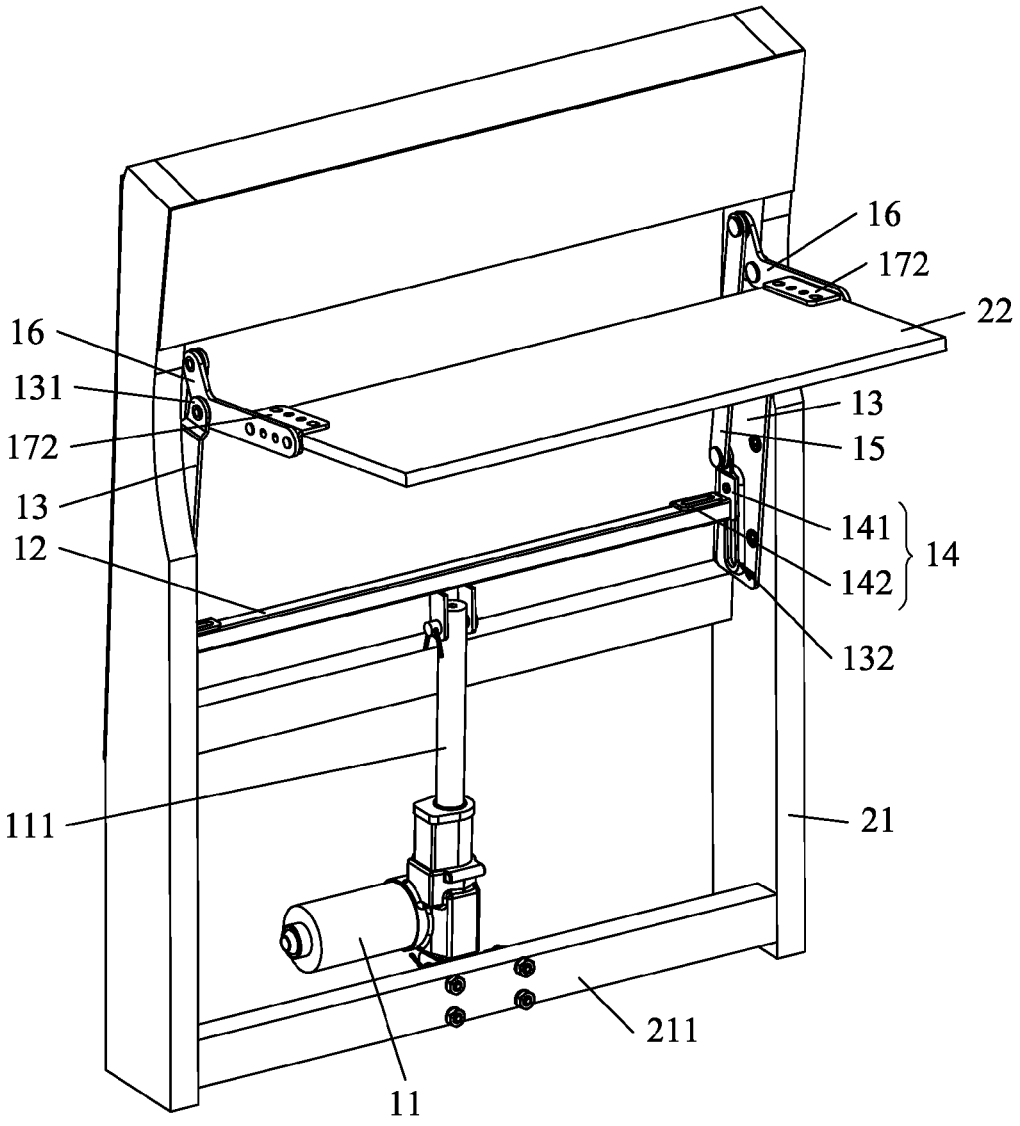
FIG. 6 is a perspective view of the electric support system for sofa of the present invention, the angle of a flat plate thereof has been adjusted.

As the second connecting link 16 is pivotally connected to the side plate 13, thus the upward rotation of the first segment 161 results in downward rotation of the second segment 162, thereby the flat plate 22 can rotate forward relative to the base 21 so as to change the angle thereof. Stopping the linear drive device 11 when the flat plate 22 moves to a certain position, as shown in FIG. 6, then the plat plate 22 is positioned and locked in this position. Starting reversely the linear drive device 11 to retract the output shaft 111 so as to drive the plat plate to move back.

Figure 7:
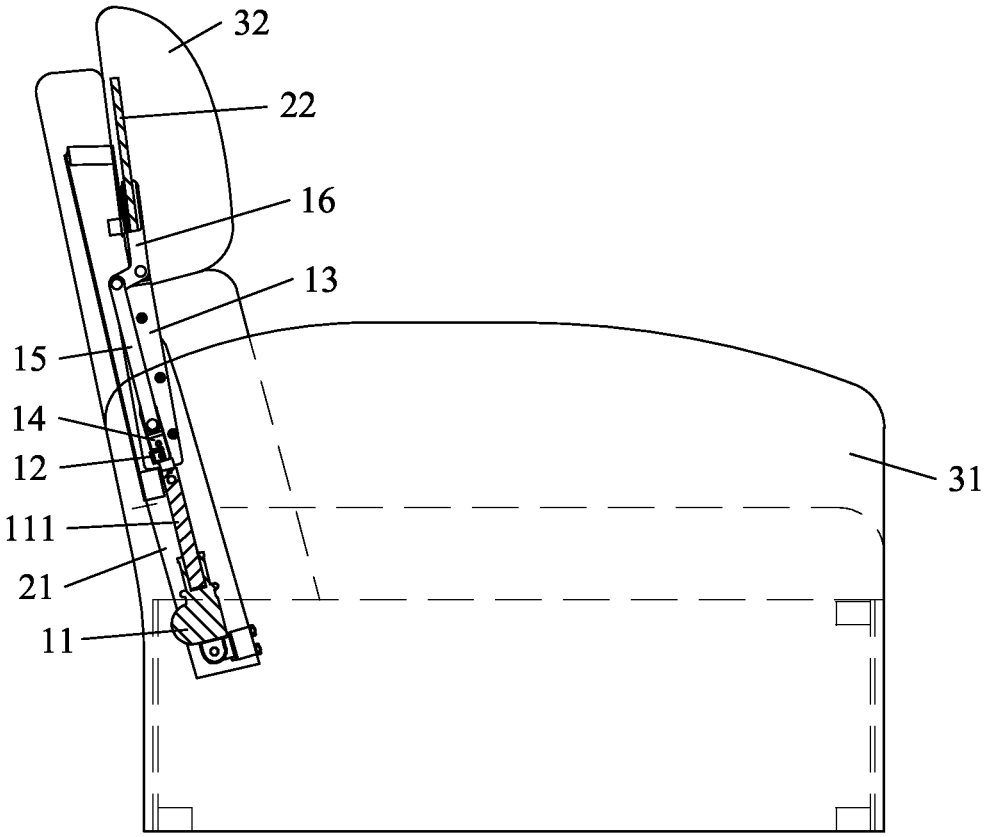
FIG. 7 is a schematic view of the electric support system for sofa mounted in the sofa.
Figure 8:
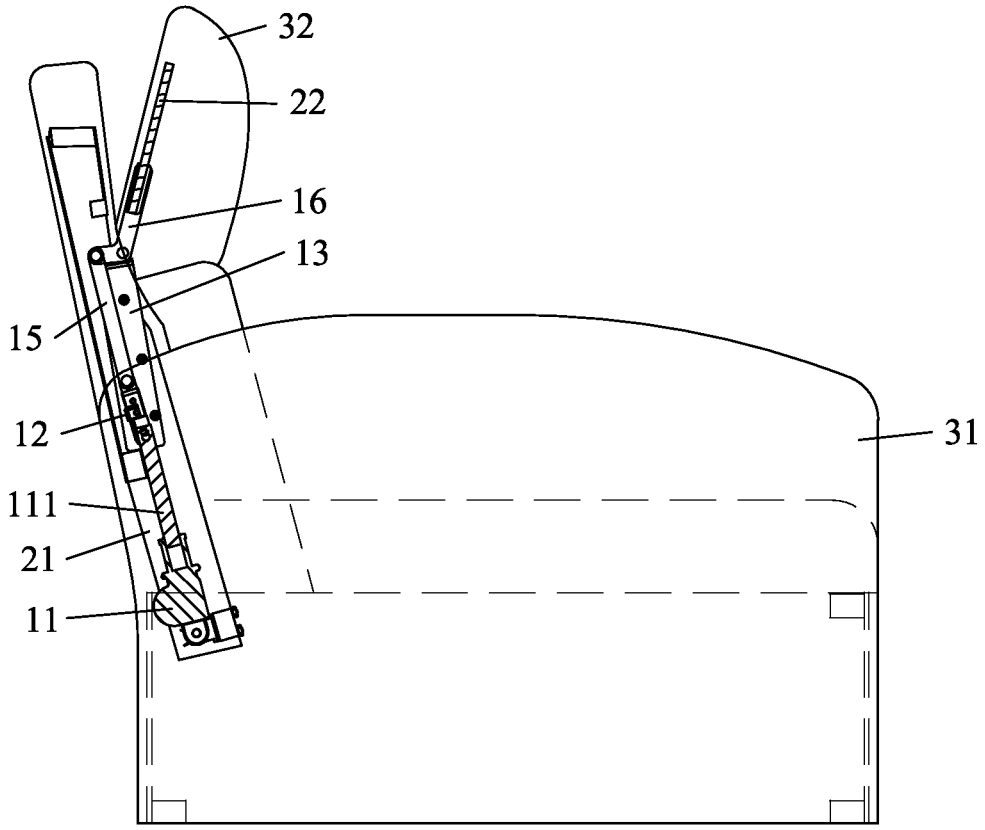
FIG. 8 is a schematic view of the electric support system for sofa of the present invention, the head rest of the sofa has been adjusted by the electric support system for sofa.

FIGS. 7 and 8 show the support pedestal and electric support system for sofa 1 mounted in a sofa 31 and connected with the headrest 32, the angle of the headrest 32 can be adjusted with the above adjusting operation for reciprocating movement of the plat plate 22.

Compared with the prior art, since the angle of the headrest is adjusted by applying a linear drive device 11 to push the adjusting assembly, the structure thereof is flexible, and the headrest 32 can be adjusted to any desired angle or position without limitations, As long as the linear drive device starts in a reverse direction, the headrest can be adjusted back, the operation of which is convenient.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An electric support system for sofa, comprising a linear drive device and at least one adjusting assembly, the adjusting assembly comprising a side plate, a slider, a first connecting link, and a second connecting link;

wherein the slider is slidably configured on the side plate and driven by the linear drive device to slide on the side plate, one end of the first connecting link is pivotally connected to the slider, the other end of the first connecting link is pivotally connected to one end of the second connecting link, the other end of the second connecting link is an end adapted for fixing a headrest, and the second connecting link is also pivotally connected to the side plate with a pivot configured between the two ends of the second connecting link;

wherein the first connecting link is a linear link, the second connecting link includes a first segment and a second segment, one end of the first segment is pivotally connected to the first connecting link, the other end of the first segment is fixed to one end of the second segment and there is an angle between the first segment and the second segment, the other end of the second segment is the end adapted for fixing the headrest, and the pivot is located at a position where the first segment is fixed to the second segment;

wherein a sliding hole is opened in the side plate, and the slider is slidably configured in the sliding hole, the sliding hole is configured to be oblique to a length direction of the side plate, and the linear drive device is correspondingly configured to be oblique;

wherein the second connecting link is pivotally connected to a front end of the side plate, the first segment is protruded from the pivot to a rear end of the side plate, and the sliding hole extends from the top down and towards the front end of the side plate.

2. The electric support system for sofa according to claim 1, wherein the adjusting assembly further comprises a fastener, which comprises a first fixing portion and a second fixing portion that is fixed and roughly perpendicular to the first fixing portion, and the first fixing portion is fixed to the end adapted for fixing headrest of the second connecting link.

3. The electric support system for sofa according to claim 1, wherein pivoting axis of the first connecting link and the slider, pivoting axis of the first connecting link and the second connecting link, and pivoting axis of the second connecting link and the side plate are configured in parallel.

4. The electric support system for sofa according to claim 1, wherein the number of the adjusting assembly is two, and the electric support system for sofa further comprises a connecting rod, two ends of which are respectively fixed to the sliders of the two adjusting assemblies, and the linear drive device is connected to the connecting rod.

5. The electric support system for sofa according to claim 4, wherein the linear drive device has a rectilinearly telescopic output shaft, which is pivotally connected to the connecting rod.

6. The electric support system for sofa according to claim 5, wherein the linear drive device comprises a linear motor.

* * * * *